US005931661A

United States Patent [19]

Kingery

[11] Patent Number: 5,931,661

[45] Date of Patent: Aug. 3, 1999

[54] ADJUSTABLE AIR/GAS SHUTTER VALVE

[75] Inventor: Dennis Carl Kingery, Mount Pleasant, Iowa

[73] Assignee: Hearth Technologies Inc., Lakeville, Minn.

[21] Appl. No.: 09/031,140

[22] Filed: Feb. 26, 1998

[51] Int. Cl.[6] ..... F23D 14/62

[52] U.S. Cl. ..... 431/354; 126/512; 48/180.1

[58] Field of Search ..... 126/512; 431/354, 431/355; 48/180.1

[56] References Cited

U.S. PATENT DOCUMENTS

| | | | |
|---|---|---|---|
| 1,281,300 | 10/1918 | Cross | 431/354 |
| 1,314,003 | 8/1919 | Leese | 48/180.1 |
| 1,485,371 | 3/1924 | Curran | 431/355 |
| 2,359,002 | 9/1944 | Carroll | 48/180.1 |
| 2,474,957 | 7/1949 | Reeves | 48/180.1 |
| 3,818,937 | 6/1974 | La Ganke | 431/354 |
| 3,905,756 | 9/1975 | Ferlin et al. | 431/354 |
| 4,702,691 | 10/1987 | Ogden | 431/354 |
| 5,553,603 | 9/1996 | Barudi et al. | 126/512 |
| 5,667,375 | 9/1997 | Sebastiani | 431/354 |

FOREIGN PATENT DOCUMENTS

| | | | |
|---|---|---|---|
| 477846 | 11/1915 | France | 48/180.1 |

*Primary Examiner*—Carroll B. Dority
*Attorney, Agent, or Firm*—John B. Sowell ATY

[57] ABSTRACT

An air to gas mixing valve is provided for fireplaces especially those having sealed combustion chambers as employed in direct vent fireplaces. The novel mixing valve comprises a channel shaped shutter which mounts on and is linearly slidable over a window or windows made a part of the gas mixing pipe which connects to the fireplace burner. An adjustment rod is rotatably coupled to an actuating arm on the channel shaped shutter and extends through at least one sealed panel and has a rotatable nut or screw for linearly moving the shutters over the windows from a remote position.

11 Claims, 6 Drawing Sheets

ADJUSTABLE AIR/GAS SHUTTER VALVE

BACKGROUND OF THE INVENTION

1. Field of the Invention

The present invention relates to gas fireplaces. More particularly, the present invention relates to a novel valve for adjusting the air to gas mixture delivered to a burner of a gas fireplace.

2. Description of the Prior Art

Heretofore, gas mixing valves were well known.

The trend in gas mixing valves for gas fireplaces has been to provide a low cost device which is adjustable. However, once adjusted to provide the correct mixture for a particular gas burner, nozzle position and gas line pressure, the setting is then permanent and is no longer easily accessible. In some gas fireplaces, the gas burner is in the form of a pipe which has apertures and is placed above the floor of the fireplace, however, it is a common practice to place the air gas mixing valve out of sight or below the floor. In direct vented fireplaces, and other gas fireplaces which have sealed glass doors, the gas mixing valve is placed below the floor of the fireplace in a sealed area or in an inaccessible area.

Accordingly, it would be desirable to provide a low cost adjustable gas mixing valve that can be adjusted at its optimum mixing setting while operating under actual conditions of gas pressure and burner usage.

SUMMARY OF THE INVENTION

It is a primary object of the present invention to provide a remotely adjustable air/gas mixing valve for installation in an inaccessible space.

It is a another primary object of the present invention to provide an easy to manufacture air/gas mixing valve with a minimum number of low cost components.

It is a another primary object of the present invention to provide an air/gas mixing valve for use with a large range of gas fireplaces.

According to these and other objects of the present invention, there is provided an air/gas mixing valve which is an inaccessible area inside of a fireplace enclosure and comprises a gas mixture pipe that connects to a gas burner. The gas mixture pipe is provided with an open window in its side and a gas jet in its end. A metal shutter is slidably mounted on the mixture pipe and has a flat panel portion which is remotely adjustable to open and close the window on the gas mixture pipe. An adjustment rod has a rotatable control remote from the metal shutter and an end which is coupled to the metal shutter so that adjustment of the remote end of the adjustments rod opens and closes the window on the gas mixture pipe to provide control of the air to gas mixture to a gas burner system from a point remote from the mixing valve.

DESCRIPTION OF THE PREFERRED EMBODIMENTS

Figure 1:
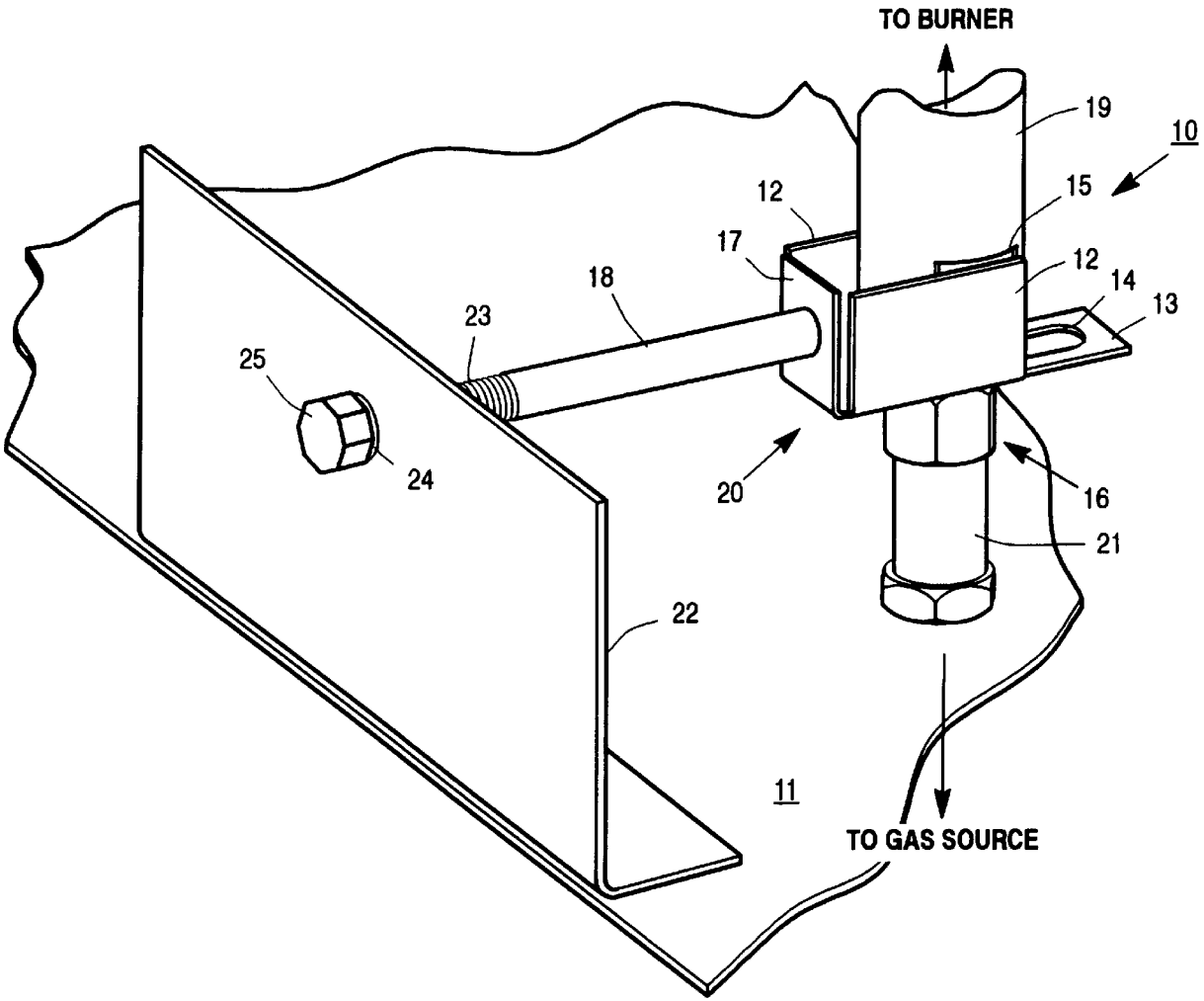
FIG. 1 is an isometric view of the present invention air/gas shutter valve with the shutter closed over the window.

Refer now to FIG. 1 showing an isometric view of the present invention air/gas shutter valve 10 positioned inside of a prefabricated fireplace 11 (shown in part). Valve 10 is shown having a pair of shutter elements 12 extending vertically upward from a guide plate 13 shown having a guide aperture 14 therein. The purpose of the guide aperture 14 is to provide lateral stabilization to the shutter elements and to limit their axial movement over the windows 15. The guide plate 13 may rest on and be slidably mounted on the gas jet means 16 which may be made in one or more parts.

The rear of the guide plate 13 is further provided with a vertically extending actuating arm 17 which is coupled to a rotatable adjustment rod 18. The rod 18 may be coupled to arm 17 with a bearing element or keeper such as a washer and/or a cotter pin (not shown).

In the preferred embodiment of FIG. 1 it will be seen that the channel shaped shutter 20 which comprises elements 12, 13 and 17 may be made from a single stamped and formed piece of sheet metal, and that the windows 15 in gas mixing pipe 19 may be made by machined or removing a segment or segments.

In the preferred embodiments to be explained hereinafter, the gas jet means 16 is connected to gas pipe means 21, shown as a coupling, used for connecting the gas jet 16 to a source of gaseous fuel (not shown). When connected to a source of gas the coupling 21 forms a support in space for the shutter 20. In a similar manner when gas mixing pipe 19 is connected to a burner, it too is fixed in space. The gas mixing pipe may be connected to fireplace gas burners such as those described in U.S. Pat. No. 5,601,073 which show and describe pipe burners and pan type burners.

Actuating rod 18 is shown extending forward through a vertical panel 22 which may be a vertical closure panel at the front of fireplace 11. In a direct vented fireplace 11, the shutter valve 10 may be located in a sealed compartment below the floor of the combustion chamber. When the sealed compartment is connected to a source of outside combustion air, the air mixed in the valve 10 is not stolen from the room in which the fireplace is located. Preferably, adjustment rod 18 is provided with threads 23 which cooperate with a bearing 24 fixed in panel 22. A hexagonal head 25 on rod 18 permits the shutter 20 to be moved over windows 15 while the fireplace is in operation, thus permitting an optimum fuel/air mixture to be obtained without the need to disassemble any part of the fireplace after being initially placed in operation. Other types of actuating mechanisms may be employed to move shutter 20 over windows 15 without causing a leak or break in the sealed fireplace.

Figure 2:
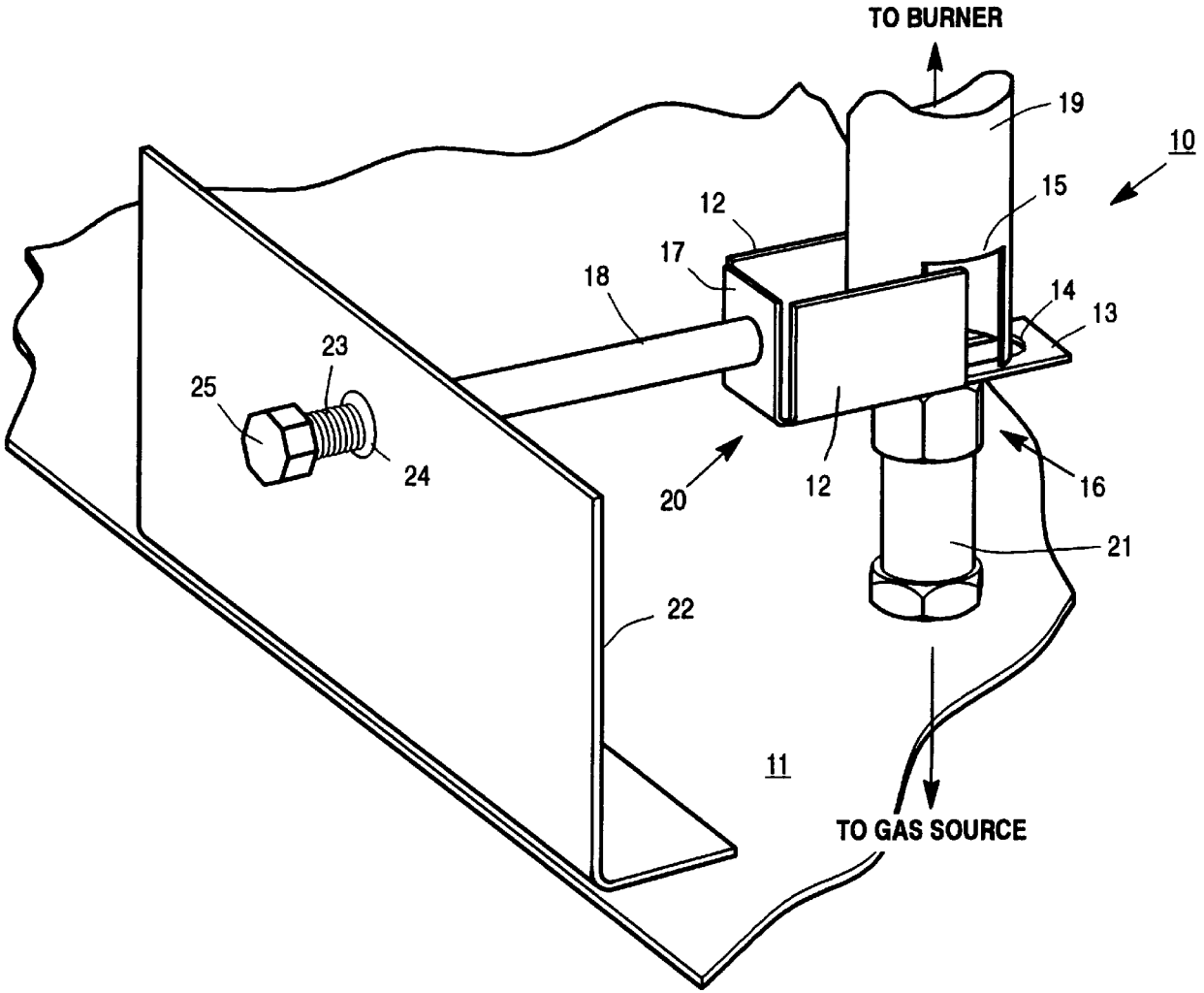
FIG. 2 is an isometric view of the air/gas shutter valve shown in FIG. 1 with the window on the gas mixture pipe partially open.

Refer now to FIG. 2 showing an isometric view of air/gas valve of FIG. 1 with the shutter 20 partially open and the adjustment rod 18 extending outward in the front of the fireplace. The elements and numerals in FIG. 1 which are the same as those shown and described in FIGS. 2 to 4 are numbered the same and do not require additional explanation.

Figure 3:
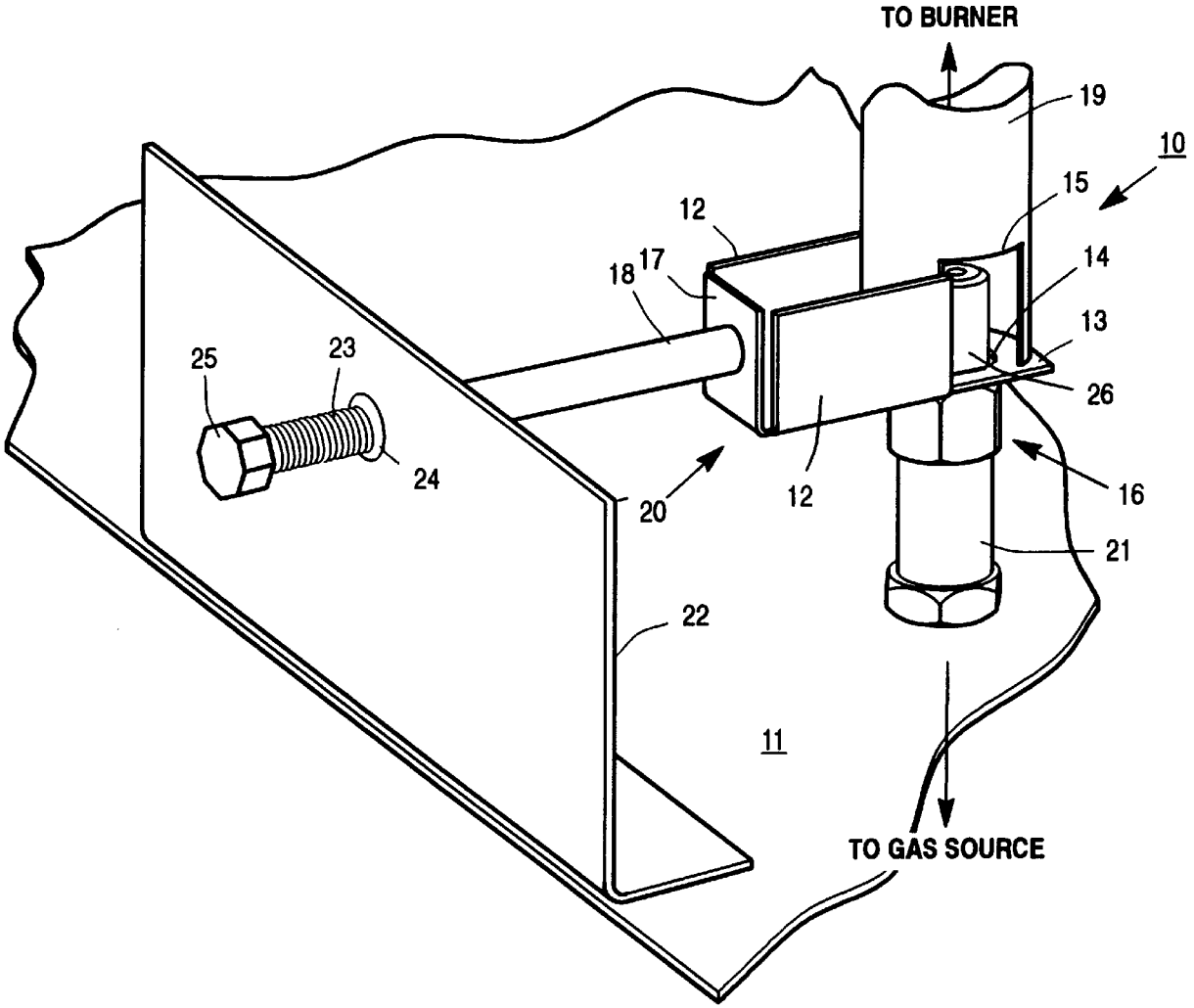
FIG. 3 is an isometric view of the air/gas shutter valve shown in FIGS. 1 and 2 with the window full open.

Refer now to FIG. 3 showing the same air/gas valve shown in FIGS. 1 and 2 with the shutter full open and the adjustment rod 18 extended further outward in the front of the fireplace 11. In this position, a removable and replaceable gas jet 26 is shown mounted on coupling 21 and held by a hut 27 of gas jet means 16.

Figure 4:
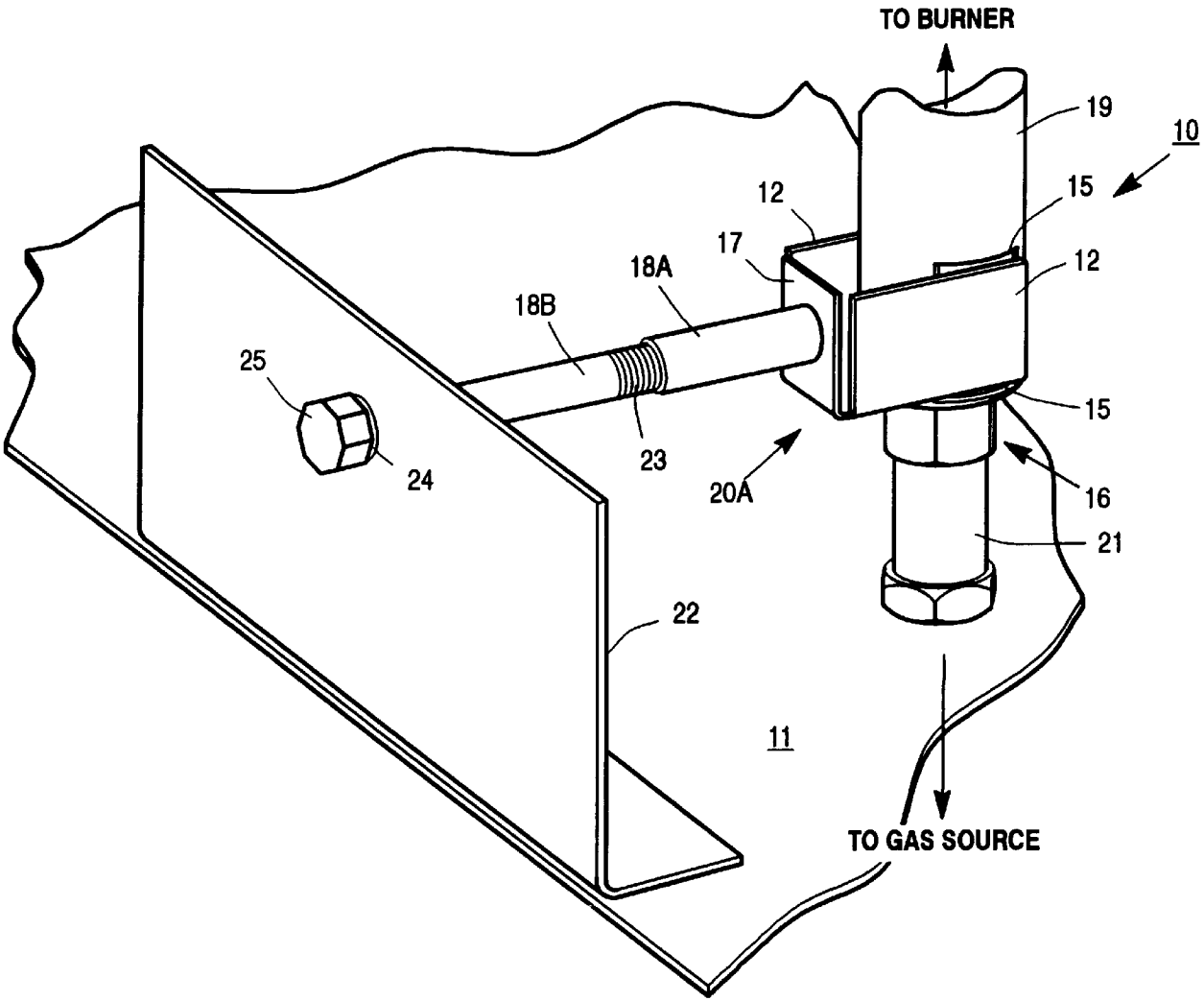
FIG. 4 is an isometric view of a modified air/gas valve of FIG. 1 having a modified shutter and control adjustment rod.

Refer now to FIG. 4 showing an isometric view of an air/gas valve similar to FIGS. 1 to 3 having a bifurcated shutter 20A actuated by a two piece actuating rod 18A, 18B. In this embodiment, the rod 18B is threaded into the female threads in rod 18A. The hexagonal nut 25 does not move in or out when turned but feeds rod 18B into the threaded sleeve 18A. It will be noted that shutter elements 12 may be guided by the upper and lower edges of window 15 which stabilize the shutter 20A that may be operated over a single or double windows in gas mixing pipe 19. Preferably rod 18B is sealed but rotatable in bearing 23. Plate 13 with aperture 14 may be eliminated and other stop means may be mounted on shutter 20.

Figure 5:
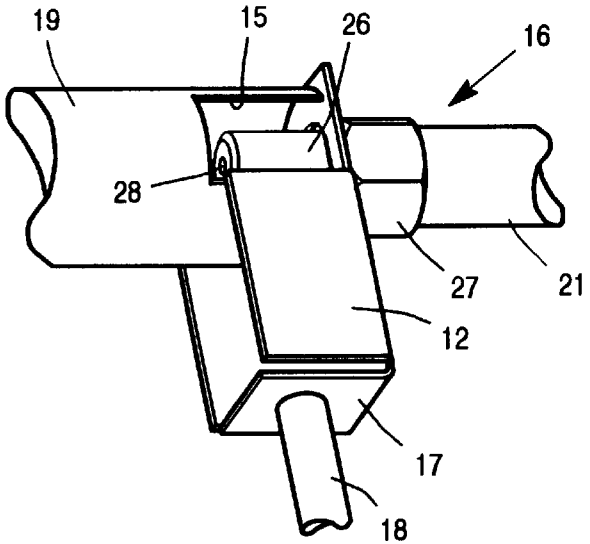
FIG. 5 is an isometric view of the air/gas valve of FIG. 3 showing a horizontal gas mixture pipe.

Refer now to FIG. 5 showing an air/gas valve similar to FIG. 3 where the gas mixing pipe 19 and gas pipe coupling 21 are horizontally oriented. All other elements are the same as those shown and described hereinbefore.

Figure 6:
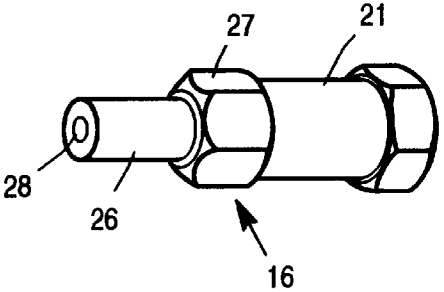
FIG. 6 is an isometric view of a gas jet of the type which inserts into the gas mixture pipe.

Refer now to FIG. 6 showing a isometric view of gas jet means 10 used in the shutter valves 10 shown in FIG. 1 to 4. The gas jet 26 is provided with precision sized orifice 28 which is usually stamped (embossed) in the solid brass jet. This replaceable jet enables burners of the same size to have different heating output.

Figure 7:
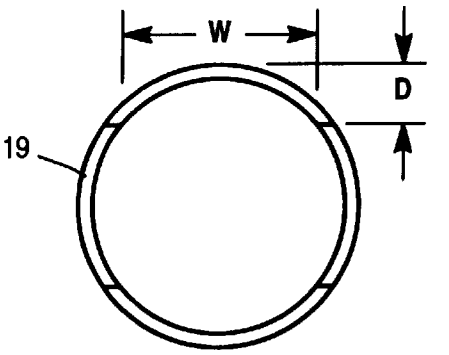
FIG. 7 is a section through the gas mixture pipe showing a symmetrical double window structure.
Figure 8:
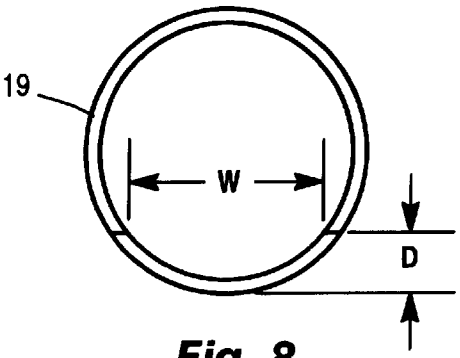
FIG. 8 is a section through the gas mixture pipe showing a single window structure.

Refer now to FIGS. 7 and 8 showing a sectional end view taken through the windows 15. The gas mixing pipe 19 may be provided with double windows 15 or single windows 15 having a width W and a depth D. The windows may be cut and/or ground using conventional cutting tools. Any burrs resulting from cutting are preferably removed to provide a smooth surfaced for shutters 12.

Figure 9:
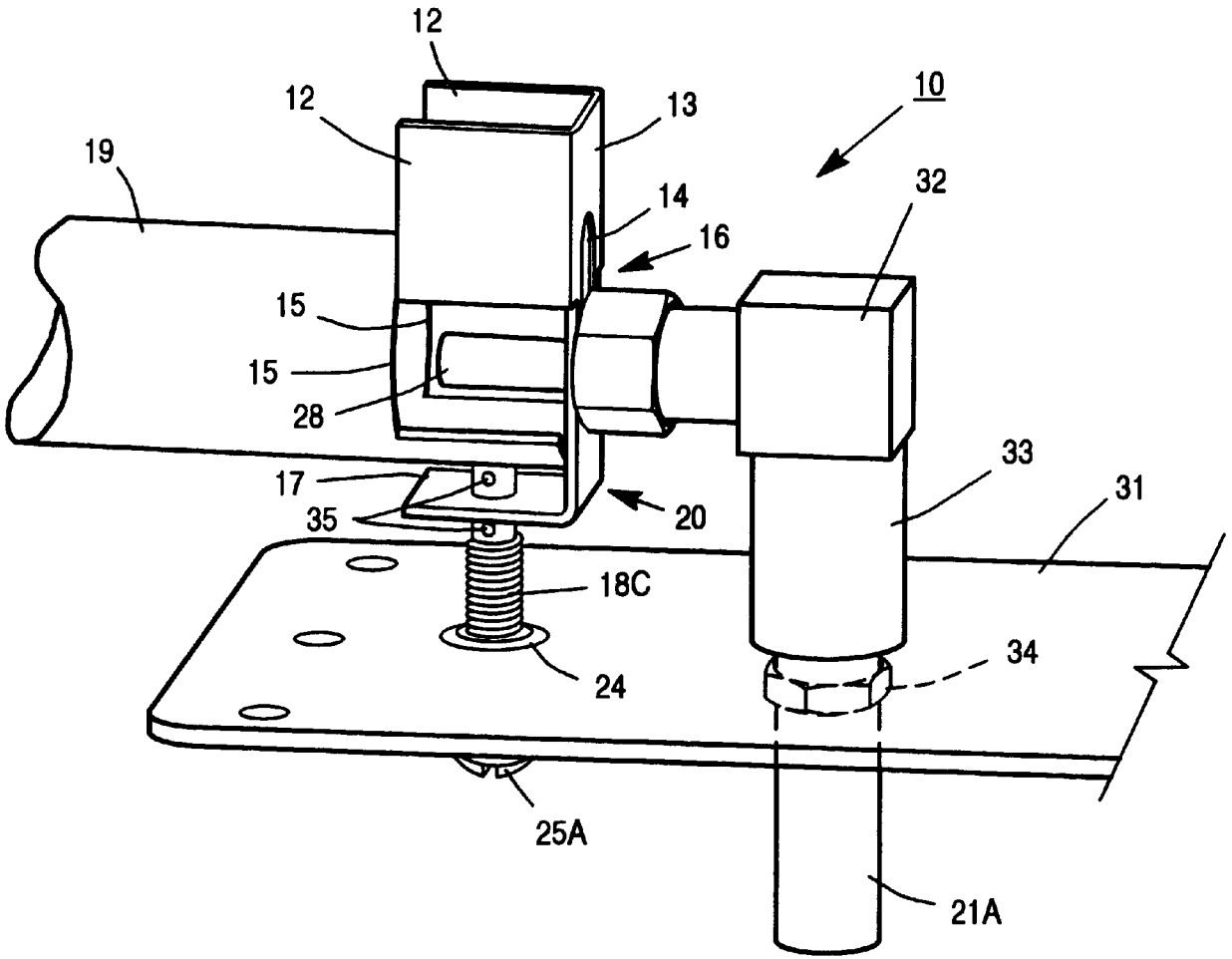
FIG. 9 is an isometric view of another air/gas valve similar to FIGS. 1 and 4 having a vertically movable shutter and adjustment rod.

Refer now to FIG. 9 showing an isometric view of an air/gas valve similar to FIGS. 1 to 4 having a vertically movable shutter 20 and adjustment rod 18C. The adjustment rod 18C is threaded into a sealed bushing 29 fixed in horizontal bulkhead plate 31. The gas jet means 16 is mounted on bulkhead elbow 32 which is provided with a cylindrical portion having female threads. The end of cylinder 33 fits flush on plate 31 over an aperture (not shown). Threaded coupling 21A threads into cylinder 33 and cylinder 33 seals against plate 31 when nut 34 on coupling 21A is screwed tight against the bottom of plate 31. Rod 18A is provided with apertures 35 for receiving pins and washers to couple rod 18A to arm 17.

Any fireplace having an accessible air space under the floor of the combustion chamber can be fitted with a FIG. 9 air/gas valve in the air space. The rod 18C and gas pipe coupling 21A extend through the bottom panel of the air space which is sealed by panel 31. The screw 25A is then accessible through a front or side panel of the fireplace and may be adjusted under actual operating conditions.

Having explained how the novel shutter valve 10 may be adapted to be operable with shutters in both vertical and horizontal planes, it will be understood that other forms of actuating rods may be employed to move the shutter 20 from a remote position. The valve was designed for use in direct vented fireplaces which do not consume room air. The valve is preferably installed in the air space below a combustion chamber and has a remote control element that extends into the air space where the air/gas valve 10 is located. Once set the air/gas mixture does not vary and only need be readjusted in the event of a change in gas pressure and/or air supply.

What is claimed is:

1. An air/gas valve for controlling the air to gas mixture supplied to a gas burner inside of a fireplace, said valve comprising:

gas pipe means for connection to a source of gaseous fuels, gas jet means mounted on said gas pipe means, gas mixture pipe means for connection to a gas burner, window means in said gas mixture pipe means juxtaposed said gas jet means, shutter means operably movable over said window means for opening and closing said window means from a point remove from said window means, said shutter means comprising a guide plate extending from a channel shaped member and being provided with a guide aperture for slidably guiding or said gas jet means, and adjustment rod means coupled to said shutter means and extending to an accessible point on said fireplace for opening and closing said shutter means remote from said air/gas valve.

2. An air/gas valve as set forth in claim 1 wherein said shutter means comprises a channel shape member having at least one shutter movable over a window means.

3. An air/gas valve as set forth in claim 2 wherein said shutter means comprises a pair of shutters movable over a pair of windows in said gas pipe means.

4. An air/gas valve as set forth in claim 3 wherein said pair of shutters are spring biased toward each other and slidably engage said window means.

5. An air/gas valve as set forth in claim 3 wherein said pair of shutters are spring biased toward each other and only one of said shutters is slidably engagable with a window of said window means.

6. An air/gas valve as set forth in claim 2 wherein said window means comprise a pair of windows and said shutter means comprise a pair of linear slidable shutters cooperating with said window means.

7. An air/gas valve as set forth in claim 1 wherein said shutter means is linearly slidable in an axis other than orthorgonal to the axis of said gas mixture pipe for opening or closing said window means machined onto an end of said gas mixture pipe.

8. An air/gas valve as set forth in claim 1 which is mounted in an air space below a combustion chamber of a fireplace.

9. An air/gas valve as set forth in claim 8 wherein said adjustment rod means and said gas pipe means extend through panels forming said air space.

10. An air/gas valve as set forth in claim 9 which further includes means for sealing said apertures in said air space.

11. An air/gas value for controlling the air to gas mixture supplied to a gas burner inside of a fireplace, said valve comprising:

gas pipe means for connection to a source of gaseous fuels, gas jet means mounted on said gas pipe means, gas mixture pipe means for connection to a gas burner, window means in said gas mixture pipe means juxtaposed said gas jet means, shutter means operably movable over said window means for opening and closing said window means from a point remove from said window means, said shutter means being slidable in an axial direction orthogonal to the axis of said gas mixture pipe, said shutter means having edges which slidably engage edge portions of said window and are guided thereby, and adjustment rod means coupled to said shutter means and extending to an accessible point on said fireplace for opening and closing said shutter means remote from said air/gas valve.

* * * * *